US007788885B2

(12) United States Patent
Sandberg et al.

(10) Patent No.: US 7,788,885 B2
(45) **Date of Patent: *Sep. 7, 2010**

(54) METHOD OF LOADING FOOD STACKS

(75) Inventors: Glenn Sandberg, New Lenox, IL (US); Scott A. Lindee, Mokena, IL (US); James Wrona, Gainesville, GA (US); James E. Pasek, Tinley Park, IL (US)

(73) Assignee: Formax, Inc., Mokena, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/030,197

(22) Filed: Feb. 12, 2008

(65) Prior Publication Data

US 2008/0230353 A1 Sep. 25, 2008

Related U.S. Application Data

(63) Continuation of application No. 11/327,836, filed on Jan. 6, 2006, now Pat. No. 7,328,542, which is a continuation-in-part of application No. 10/923,097, filed on Aug. 20, 2004, now abandoned.

(60) Provisional application No. 60/701,757, filed on Jul. 23, 2005.

(51) Int. Cl.
*B65B 35/36* (2006.01)
*B65B 35/16* (2006.01)
*B65B 25/06* (2006.01)

(52) U.S. Cl. ..... 53/473; 53/248; 53/258; 198/812

(58) Field of Classification Search ..... 53/475, 53/473, 447, 435, 517, 122, 157, 537, 535, 53/536, 238, 247, 248, 251, 255, 257, 258, 53/259, 260, 261; 198/812, 460.2, 594
See application file for complete search history.

(56) References Cited

U.S. PATENT DOCUMENTS 3,080,033 A 3/1963 Graeme (Continued)

FOREIGN PATENT DOCUMENTS

DE 3238523 A1 * 5/1983

(Continued)

OTHER PUBLICATIONS

Machine translation of EP0476301, from http://epo.worldlingo.com/wl/epo/epo.html, 7 pages, retrieved on Sep. 25, 2009.*

*Primary Examiner*—Stephen F Gerrity
(74) *Attorney, Agent, or Firm*—Erickson Law Group, PC

(57) ABSTRACT

A method is provided for loading stacked food product into packages. Open top containers are arranged in rows and movable into a loading station. A shuttle conveyor has a retractable and extendable conveying surface, the conveying surface having an end region extendable to a position arranged above the containers of a row of the containers. A guiding and pushing apparatus is arranged above the row and includes guides that are lowered to capture a row of stacked food products on the conveying surface, and plungers within the guides that lower and press a top of the stacks. When the conveying surface is retracted from beneath the guides and the row of containers, the guides are lowered further, adjacent to the containers, and the plungers are lowered with respect to the guides to push the stacks into the containers.

17 Claims, 19 Drawing Sheets

U.S. PATENT DOCUMENTS 3,354,613 A * 11/1967 Anderson et al. ..... 53/251
3,778,965 A 12/1973 Lenick et al.
3,846,958 A * 11/1974 Divan ..... 53/517
3,952,478 A * 4/1976 Richards et al. ..... 53/122
4,030,620 A * 6/1977 Euverard et al. ..... 53/473
4,048,784 A * 9/1977 Toby ..... 53/248
4,051,652 A 10/1977 Hirano et al.
4,057,951 A * 11/1977 Schneider ..... 53/55
4,137,604 A * 2/1979 Sandberg et al. ..... 53/157
4,233,799 A 11/1980 Caille
4,236,855 A * 12/1980 Wagner et al. ..... 53/157
4,416,103 A * 11/1983 Ewer et al. ..... 53/517
4,474,092 A * 10/1984 Mally et al. ..... 83/26
4,478,024 A * 10/1984 Vedvik et al. ..... 53/473
4,597,704 A * 7/1986 Vedvik et al. ..... 414/788
4,645,400 A * 2/1987 Mally et al. ..... 414/788
4,648,237 A * 3/1987 Total ..... 53/473
4,684,008 A * 8/1987 Hayashi et al. ..... 198/436
4,709,535 A * 12/1987 Mahaffy et al. ..... 53/473
5,018,338 A 5/1991 Jurchuk et al.
5,054,266 A * 10/1991 Mello et al. ..... 53/433
5,195,305 A * 3/1993 Dambrosio et al. ..... 53/473
5,207,311 A * 5/1993 Terai ..... 198/419.1
5,327,704 A * 7/1994 Hoekzema et al. ..... 53/252
5,398,479 A 3/1995 Diete et al.
5,403,056 A * 4/1995 Wallace ..... 53/475
5,566,600 A 10/1996 Johnson et al.
5,628,237 A 5/1997 Lindee et al.
5,649,463 A * 7/1997 Lindee et al. ..... 83/174
5,675,963 A * 10/1997 Nicholson et al. ..... 53/247
5,692,362 A * 12/1997 Hoyland ..... 53/473
5,697,275 A 12/1997 Lindee et al.
5,704,265 A * 1/1998 Johnson et al. ..... 83/77
5,720,149 A * 2/1998 Stimpfl ..... 53/244
5,724,874 A 3/1998 Lindee et al.
5,809,745 A * 9/1998 Reinert ..... 53/447
5,810,149 A 9/1998 Sandberg et al.
5,974,925 A 11/1999 Lindee et al.
6,484,615 B2 11/2002 Lindee
6,810,637 B2 * 11/2004 Weber ..... 53/260
6,837,030 B2 1/2005 Drebing et al.
7,065,936 B2 * 6/2006 Lindee et al. ..... 53/251
7,328,542 B2 * 2/2008 Sandberg et al. ..... 53/122
7,413,070 B2 * 8/2008 Mayer ..... 198/812
2003/0034225 A1 * 2/2003 Sandberg et al. ..... 198/460.2
2004/0118084 A1 * 6/2004 Lindee et al. ..... 53/251

FOREIGN PATENT DOCUMENTS

EP 476301 A1 * 3/1992
EP 678451 A1 * 10/1995
EP 678451 B1 3/1999
EP 0678451 B1 * 3/1999
EP 1243386 A2 * 9/2002

* cited by examiner 272
188
260
272
188
180
10
10
292
257
252
246
259
242
244
247
262
262a
259
244
246
242
247a
257c
257
257b
257a
256
252
11
11

METHOD OF LOADING FOOD STACKS

RELATED APPLICATIONS

This application is a continuation of U.S. patent application Ser. No. 11/327,836 filed Jan. 6, 2006, now U.S. Pat. No. 7,328,542, which is a continuation-in-part of U.S. patent application Ser. No. 10/923,097 filed Aug. 20, 2004, now abandoned, which claims the benefit of provisional U.S. patent application Ser. No. 60/701,757 filed on Jul. 23, 2005.

TECHNICAL FIELD OF THE INVENTION

The invention relates to fill and packaging apparatus. The invention relates to an apparatus that produces food products and places the food products in packaging.

BACKGROUND OF THE INVENTION

In the production of packaged food products, a typical arrangement comprises a food product patty former, such as a FORMAX F26 or MAXUM700 food patty forming machine, a sheet interleaving device and a take away conveyor to produce a stream of stacked patties with interleaved paper separators. Such an arrangement is disclosed for example in U.S. Pat. No. 3,952,478 or U.S. Ser. No. 60/540,022, filed Jan. 27, 2004, both herein incorporated by reference. The stacks are transported away from the patty-forming machine and manually placed into packaging.

The packaging of the stacked patties is labor-intensive.

The present inventors have recognized the advantage of reducing the reliance on manual labor in packaging food products and particularly stacked food products. The present inventors have recognized that it would be advantageous to automate the packaging of food products, particularly stacked food products.

SUMMARY OF THE INVENTION

The invention provides an automated system for loading food products into packaging. The invention is particularly adapted to effectively load food product stacks into packaging.

The invention provides an apparatus for loading food product into open top containers arranged in a row and movable into a loading station. The apparatus includes a conveyor having a retractable and extendable or movable conveying surface, the conveying surface arranged above the loading station and having an end region positionable over the row of containers and retractable to deposit food products into the containers; and a pushing assembly arranged above the row of containers and adapted to push food product into the row of containers as the conveying surface end region is retracted. The apparatus can also comprise a guide assembly arranged with the pushing assembly, the guide assembly arranged to capture the food products on the conveyor, the pushing assembly arranged to push food products from within the guide assembly into the row of containers.

According to another aspect, the invention provides an apparatus for loading food product into open top containers arranged in a row and movable into a loading station. The apparatus includes a conveyor having a retractable and extendable, or movable conveying surface, the conveying surface arranged above the loading station and having an end region positionable over the row of containers and retractable to deposit food products into the containers; and a guide assembly arranged above the row of containers and adapted to guide food products into the row of containers as the conveying surface end region is retracted.

The guide assembly can comprise a plurality of guide cylinders, or spaced-apart guide arms movable from an elevated position to a first lowered position to capture the food products on the conveyor, and to a second lowered position below the conveyor and adjacent to the row of open top containers.

Each guiding device can comprise a pair of facing concave guides, or a plurality of guide arms that are displaceable away from each other, that are movable to open up a clearance between the facing concave guides or guide arms at a bottom of the guiding device.

The apparatus can comprise a movable plunger within each guiding device, the movable plunger movable to an elevated position within the guiding device to a lowered position with respect to the guiding device to expel food product from the guiding device.

The apparatus can comprise a splash plate located below the conveying surface and having an opening corresponding in a vertical alignment with each guiding device, the opening sized and shaped to receive a bottom portion of each guiding device when moved downward.

The apparatus can receive food patties from a food patty-molding machine or slices from a food product-slicing machine.

The guide assembly includes a main pneumatic cylinder and an elevated plate supported by the main pneumatic cylinder between an elevated position and first lowered position. The guiding devices are supported by the elevated plate and the guiding devices are moved down onto the conveying surface to capture a row of stacks thereon by action of the main pneumatic cylinder.

The guiding assembly can include an intermediate plate supporting the guiding devices and supported by the elevated plate via a guide pneumatic cylinder, actuation of the guide pneumatic cylinder moving the guiding devices from a position above the conveying surface to a second lowered position wherein ends of the guiding devices are below the conveying surface.

The pushing device can comprise a rod connected to a plunger within the guide cylinder, the rod extending axially into the guide cylinder and slidable with respect to the guide cylinder. The rod is connected to a pusher drive plate, the pusher drive plate connected to the elevated plate via a pusher pneumatic cylinder, actuation of the pusher pneumatic cylinder moving the plunger with respect to the guide cylinder.

The apparatus of the invention allows for rapid loading of food products, particularly stacks of food products into product packaging. The apparatus of the invention allows for maintaining a neat verticality of the stacks being loaded into the packaging.

Numerous other advantages and features of the present invention will be become readily apparent from the following detailed description of the invention and the embodiments thereof, from the claims and from the accompanying drawings.

DETAILED DESCRIPTION OF THE PREFERRED EMBODIMENTS

Figure 1:
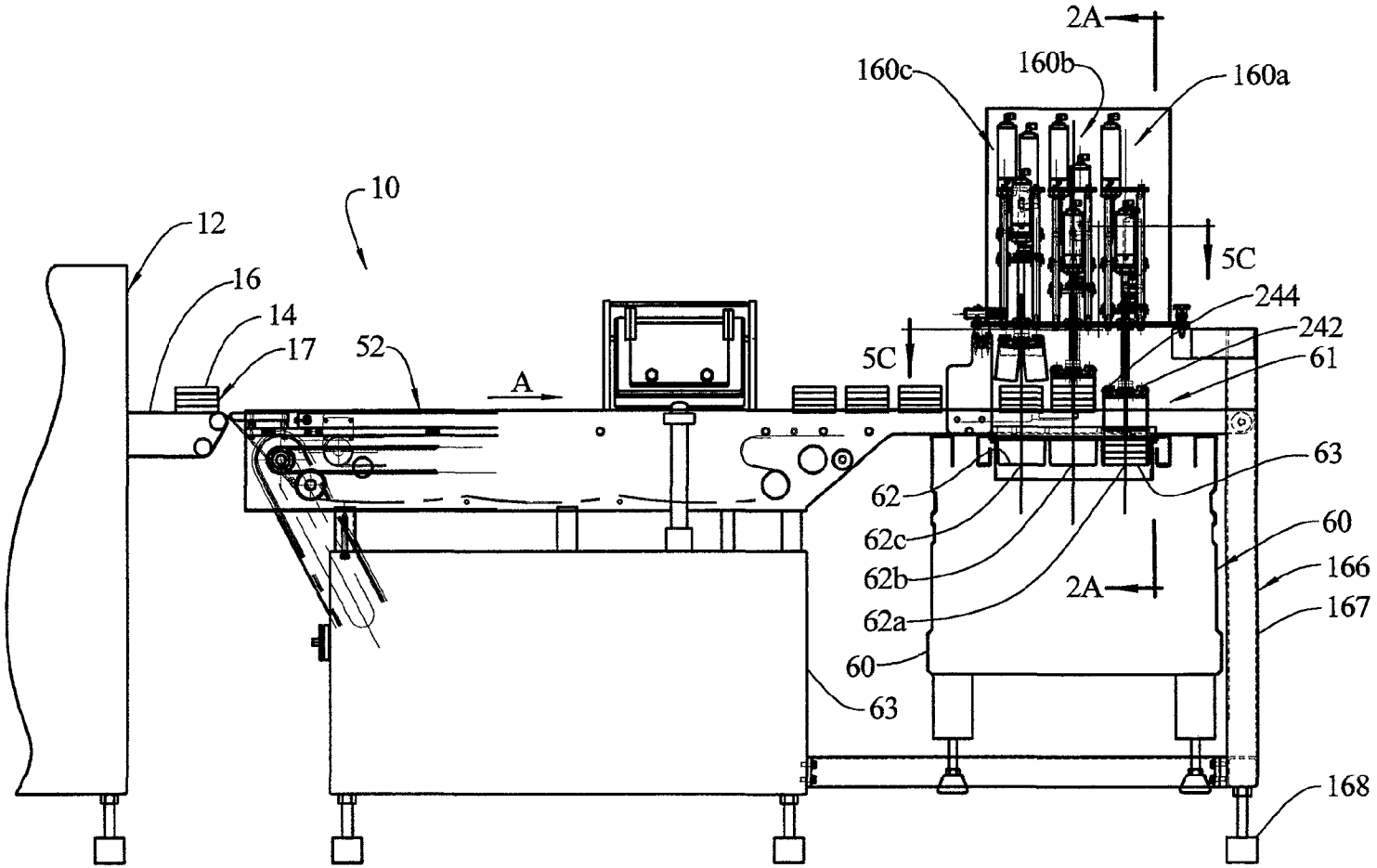
FIG. 1 is a schematic, fragmentary, elevational view of a food product forming and packaging system incorporating the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a package loading system 10 of the invention. A product producing apparatus 12, such as a patty forming apparatus with a sheet interleaving device that produces food products 14, such as formed patties, and accumulates the food products in stacks 17 feeds the apparatus 10. The stacks 17 are transported on a conveyor assembly 16 to, and onto, a shuttle conveyor 52. The shuttle conveyor transports the stacks 17 to a loading station 61 arranged above a packaging station 60. The stacks 17 are loaded by the loading apparatus into open top containers 62 in the row 62*a* in the packaging station 60 as described below.

The packaging station 60 can be a packaging machine such as a Multivac R530, available from Multivac, Inc. of Kansas City, Mo., U.S.A. At the loading station 61, the shuttle conveyor 52 delivers rows of stacks 17 into containers 62 in the form of a group of rows of pockets 62*a*, 62*b*, 62*c* formed in a lower web of film 63 by the packaging machine 60. Downstream of the loading station 61, in the direction D shown in FIG. 2A, the rows of pockets 62*a*, 62*b*, 62*c* filled with product, are sealed by an upper web of film (not shown). The direction D is shown as being perpendicular to a direction A, the direction of stack movement of the conveyor 52. The direction D however can be at any desired angle to the direction A, depending on the installation of the equipment.

FIGS. 1, 2A, 2B and 6 illustrate that the shuttle conveyor 52 includes a stationary frame 63 that supports an endless belt 80. The belt 80 forms a top conveying surface 84 and a bottom region 88. The belt 80 is wrapped around a stationary belt drive roller 89, an upper forward roller 90, an end roller 91, a bottom forward roller 92, an idler roller 93, a stationary bottom roller 94, and a stationary bottom back roller 95. The rollers 90, 91, 92, 93 are rotationally mounted on front end sideplates (not shown) to be translated to extend or retract along the direction B together. The bottom region 88 of the belt, being wrapped around the movable idler roller 93 and the stationary bottom roller 94, effectively creates a belt accumulation region 96 between these rollers 93, 94. Controlled translation of the sideplates holding the rollers 90, 91, 92, 93 controls the extension or retraction of the conveying surface 84 of the belt 80, and the position of an end region 100 of the conveying surface 84.

Two spaced-apart, side-by-side carriages 97 are provided. Each carriage 97 is connected to a corresponding front end sideplate (not shown). The rollers 90, 91, 92, 93 are effectively connected to the side-by-side carriages 97 (only one shown), via the front end sideplates. The carriages 97 are connected to a parallel pair of endless positioning belts 98 (only one shown). A servomotor 112 is operatively connected to the positioning belts 98, via drive pulleys 99, to drive an upper surface 98*a* of the belts 98 in either an advancing direction or a retracting direction. The servomotor 112 thus controls the retraction and extension of the end region 100 via movement of the carriages 97. Another servomotor 114 is operatively connected to the drive roller 89 and controls the circulation speed of the conveying belt 80. A more detailed description of a shuttle conveyor and servomotor drive components is presented in U.S. Pat. No. 6,669,005, and is herein incorporated by reference.

A controller 150, such as a programmable logic controller (PLC), a microprocessor, a CPU or other control device, is signal-connected to the servomotors 112, 114. The controller 150 synchronizes movement of the end region 100 of the conveyor 80 via the servomotor 112, and the speed of the belt 80 via the servomotor 114, with the movement of the web of film 63 of the packaging machine 60.

FIG. 1 illustrates three loading apparatuses 160*a*, 160*b*, 160*c* arranged above three rows of open top containers 62*a*, 62*b*, 62*c*. The loading apparatuses 160*a*, 160*b*, 160*c* are carried by a frame 166 that is mounted at a rear end to the stationary frame 63 of the shuttle conveyor 52 and supported at a front end by columns 167 and adjustable feet 168.

The loading apparatus 160*a* is shown in FIGS. 2A-5 and 8-12. The loading apparatus 160*b* and 160*c* are identically configured. The loading apparatus 160*a* is located adjacent to the end region 100 of the shuttle conveyor 52.

Figure 2A:
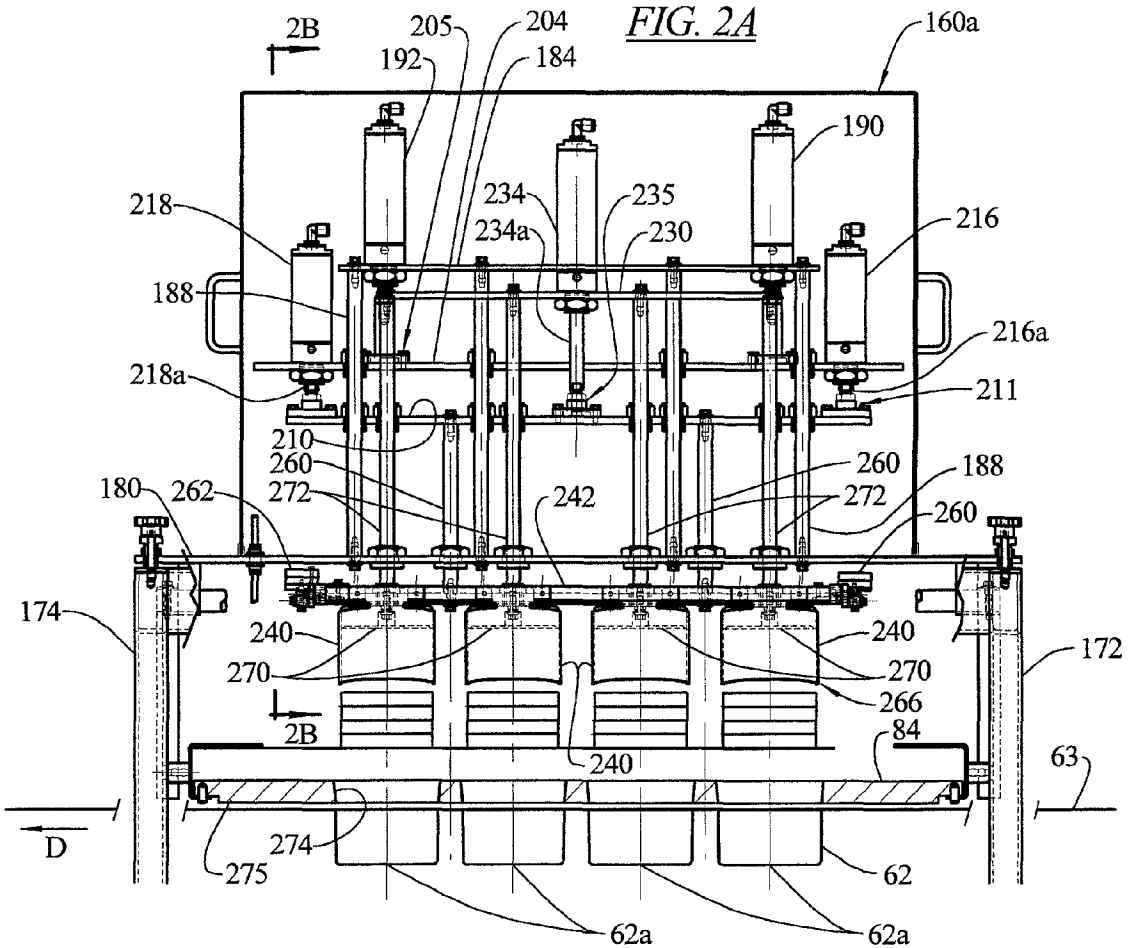
FIG. 2A is an enlarged, fragmentary sectional view taken generally along line 2A-2A of FIG. 1 with the apparatus shown in a first stage of operation.
Figure 2B:
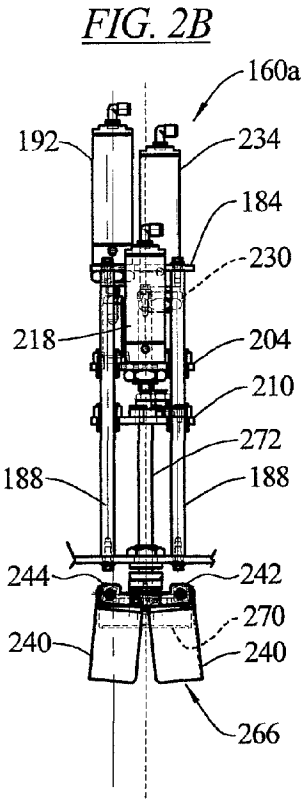
FIG. 2B is a fragmentary sectional view taken generally along line 2B-2B of FIG. 2A with the apparatus shown in a first stage of operation.

As illustrated in FIGS. 2A and 2B, the frame 166 includes walls 172, 174 that are connected by a top plate 180. An elevated support plate 184 is supported by posts 188 from the top plate 180. Two main pneumatic cylinders 190, 192 are mounted to the elevated support plate 184 and includes rods 190*a*, 192*a* that are fastened to a movable intermediate plate 204 by a fastener plate assembly 205 and fasteners 205*a* (see FIG. 5A for an unobstructed view). The fastener plate assembly 205 includes a length adjustable connection 205*b* between the rods 190*a*, 192*a* and the fastener plate assembly 205.

A movable guide plate 210 is located below the intermediate plate 204. Two guide cylinders 216, 218 are mounted to the intermediate plate 204 and include rods 216*a*, 218*a* fastened to the guide plate 210.

A plunger drive plate 230 is located above the intermediate plate 204. A plunger cylinder 234 is mounted to the plunger drive plate 230 and includes a rod 234*a* fastened to the guide plate 210 via a length adjustable fastener plate assembly 235 similar to the fastener plate assemblies 205.

As also shown in FIGS. 5C, and 9-11, arcuate food product guides 240 are fastened to pivot bars 242, 244 that are elongated in a lateral direction. The pivot bars are carried by end plates 245, 246 that are fastened to opposite ends of a central plate 247. The pivot bars are journaled for pivoting movement on the end plates about pin bolts 247*a*. The pivot bar 242 is connected by the pin bolts 247*a* to pivot with a pair of pivot levers 250, 252 at opposite ends thereof. The pivot bar 244 is connected by the pin bolts 247*a* to rotate with a pair of pivot levers 254, 256 at opposite ends thereof. The pairs of pivot levers at each end of the central plate 247 are pivotally connected at pin bolt connections 257*b*, 257*c* to a connection plate 257 that is fixedly connected to a rod 260*a*, 262*a* of a respective pivot cylinder 260, 262 by a fastener 257*a*. The pivot cylinders 260, 262 are mounted on the central plate 247 via an attachment plate 259 that is fastened to the central plate 247. As can be understood in FIG. 10, when the pneumatic cylinder 262 retracts the rod 262*a* upwardly, the connecting plate 257 is drawn upwardly and the lever 256 pivots counterclockwise as the lever 252 pivots clockwise. The pneumatic cylinder 260 is configured to operate in tandem with the pneumatic cylinder 262. The pivot bars 242, 244, being fixed to rotate with the pivot levers, will pivot in the corresponding directions, as will the arcuate guides 240 mounted to the pivot bars.

The central plate 247 is supported on a plurality of posts 260 that are fixedly connected to the guide plate 210.

The arcuate guides 240 are grouped in opposing pairs to form guide cylinders 266. Although the guide cylinders shown have substantially circular cross sections, the invention is not limited to such shape. Substantially rectangular cross section cylinders or other shape cross section cylinders are also encompassed by the invention. Within each guide cylinder 266 is a reciprocal plunger 270. The plunger is supported on a plunger rod 272 that is fastened at its upper end to the plunger drive plate 230.

In operation, as shown in FIGS. 2A and 2B, the guide cylinders 266 are spread open at their bottom ends by action of the pivot cylinders 260, 262 extending the rods 260*a*, 262*a* downward.

Figure 3A:
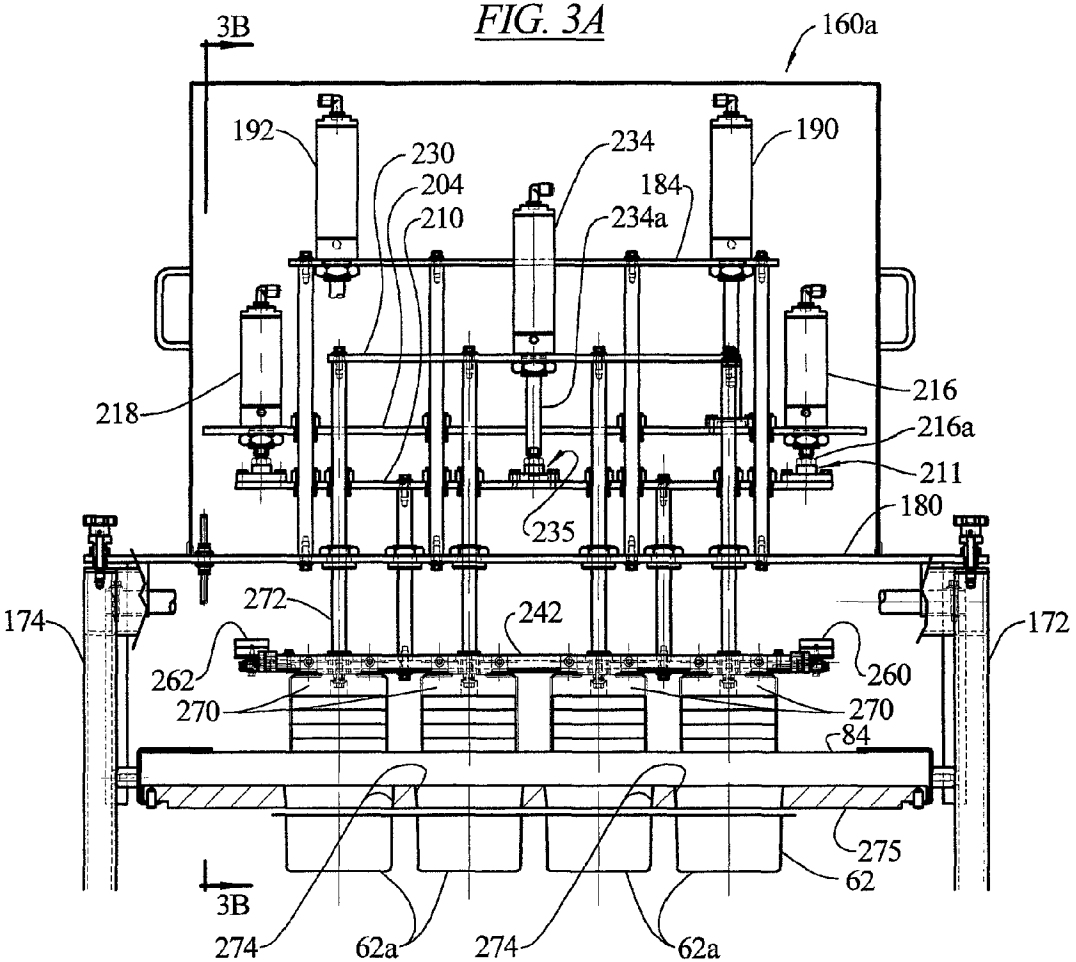
FIG. 3A is an enlarged, fragmentary sectional view taken generally along line 2A-2A of FIG. 1 with the apparatus shown in a second stage of operation.
Figure 3B:
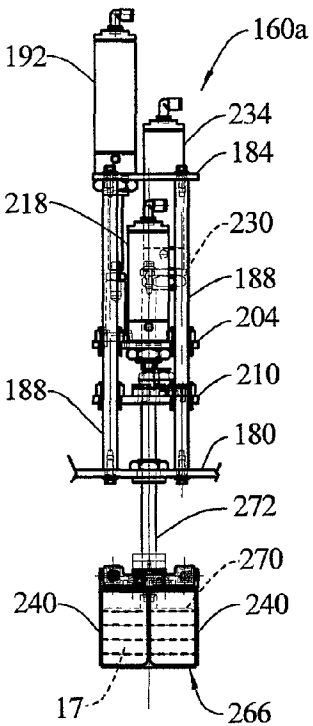
FIG. 3B is a fragmentary sectional view taken generally along line 3B-3B of FIG. 3A with the apparatus shown in a second stage of operation.
Figure 7A:
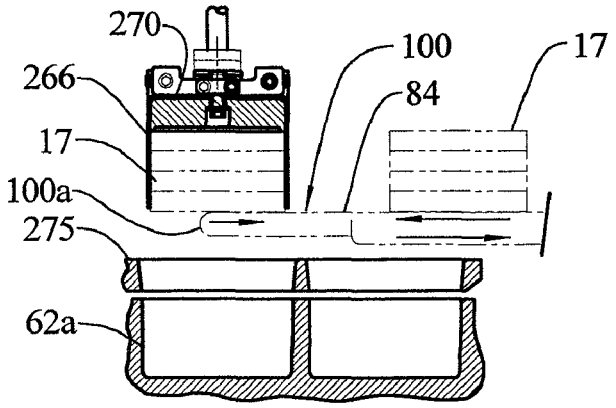
FIG. 7A-7C are schematic views showing the coordinated movements of components of the invention.

As shown in FIGS. 3A, 3B and 7A, the main cylinders 190, 192 then lower the guide cylinders 266 to capture a row of food product stacks 17 on the end region 100 of the conveyor belt 80. While a leading edge 100*a* of the end region 100 of the conveying surface 84 is retracting, the plungers 270 are lowered to press a top of the stacks 17 within the guide cylinders 266. At this point the stacks 17 that are captured within the guide cylinders 266 may only be partially supported on the conveying surface 84. The pressure from the plungers 270 along the top surface of the stacks prevents the stacks 17 from tipping forwardly.

The pivot cylinders 260, 262 are then actuated to reorient the arcuate guides 240 to a vertical orientation to make the guide cylinders 266 conform closely to the perimeter of the stacks 17, and to guide the stacks 17 for vertical downward movement.

Figure 4A:
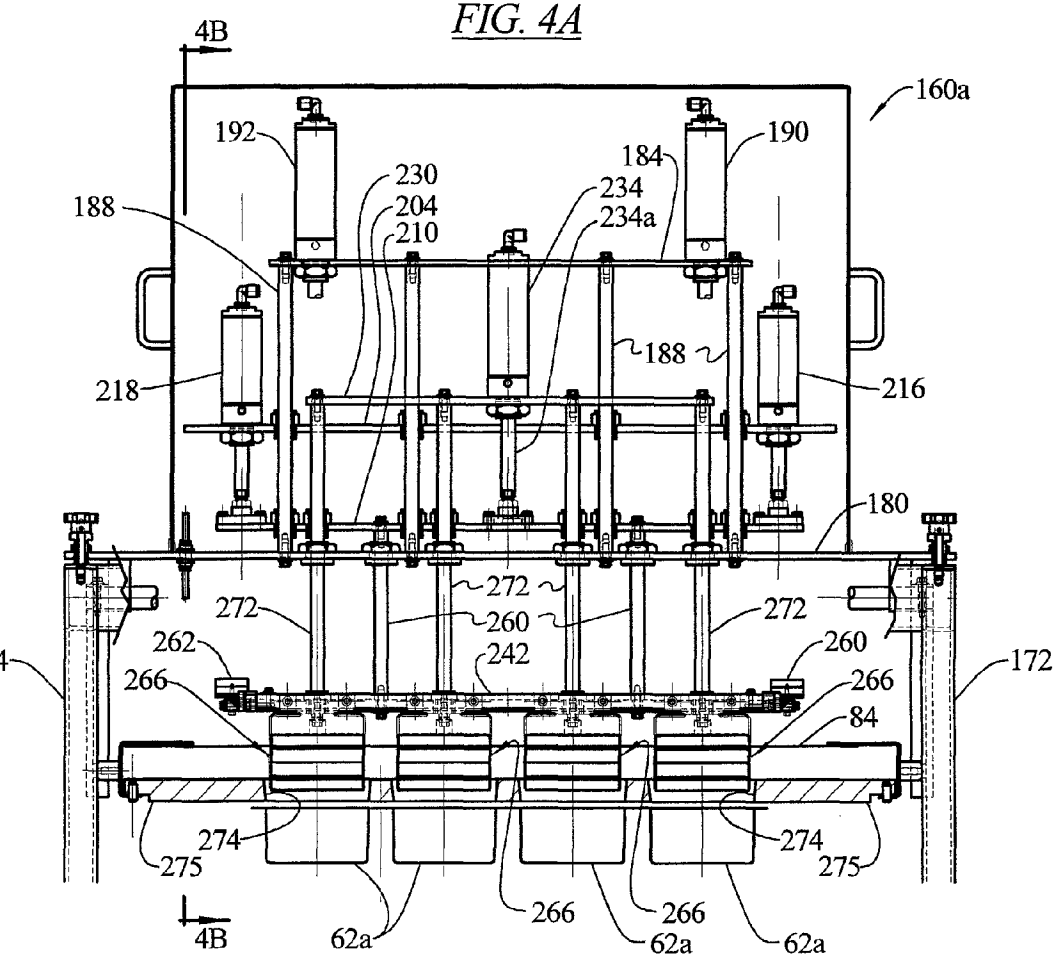
FIG. 4A is an enlarged, fragmentary sectional view taken generally along line 2A-2A of FIG. 1 with the apparatus shown in a third stage of operation.
Figure 4B:
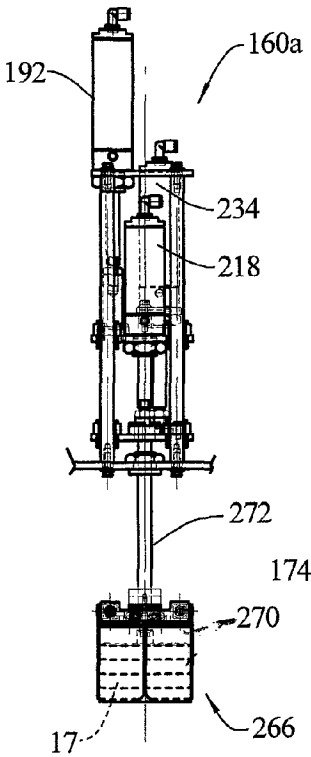
FIG. 4B is a fragmentary sectional view taken generally along line 4B-4B of FIG. 4A with the apparatus shown in a third stage of operation.
Figure 7B:
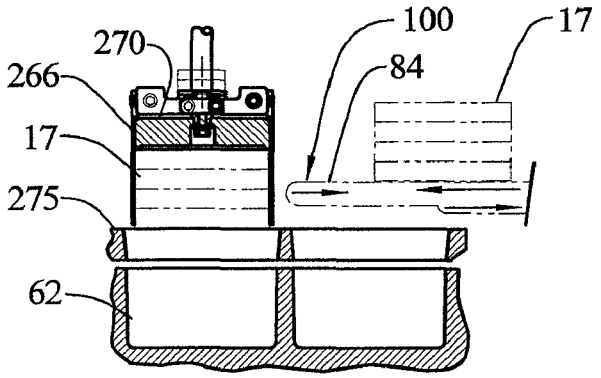

As shown in FIGS. 4A, 4B and 7B, as the leading edge 100*a* of the conveying surface 84 is retracted from beneath the stacks 17 that are captured by the guide cylinders 266, the guide cylinders 266 and the plungers 270 are then driven down, past the conveying surface 84 and into a row of holes 274 in an underlying splash plate or shield 275. The guide cylinders 266 and the plungers 270 are driven downward by action of the pneumatic cylinders 216, 218 extending their respective rods 216*a*, 218*a* to drive the plate 210 a distance from the vertical position of the plate 204.

Figure 5A:
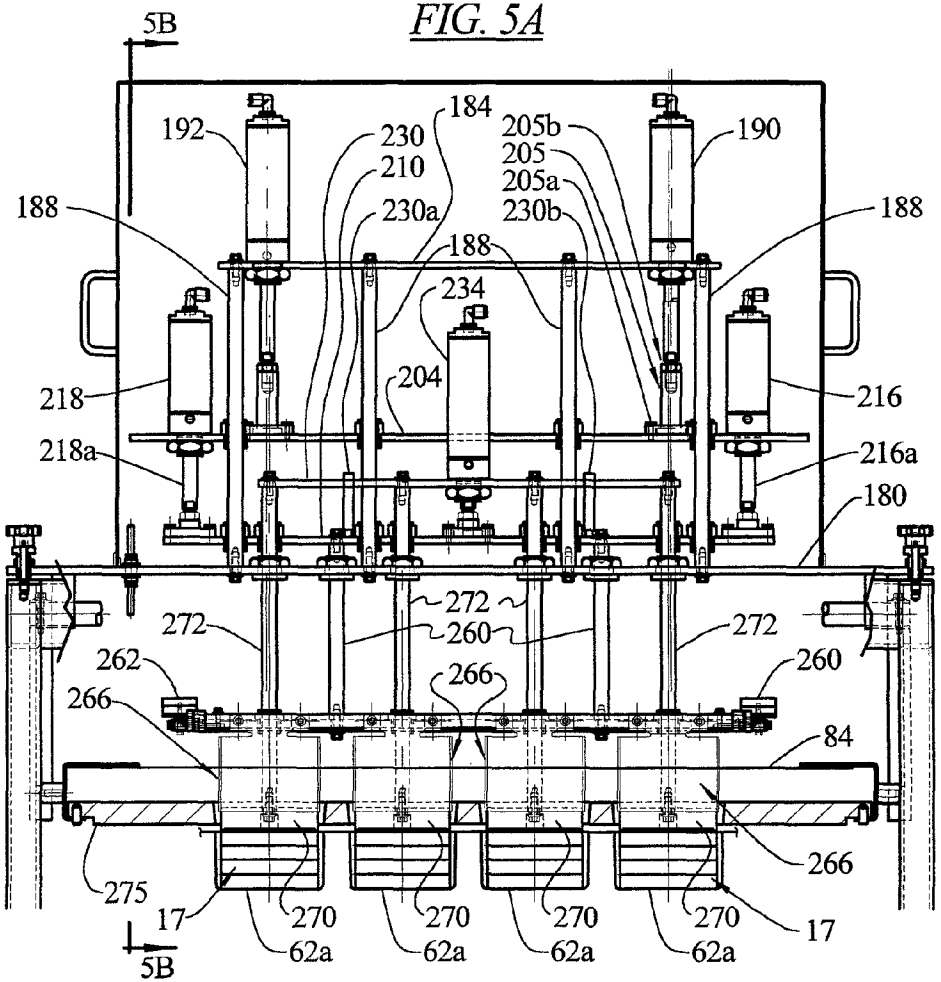
FIG. 5A is an enlarged, fragmentary sectional view taken generally along line 2A-2A of FIG. 1 with the apparatus shown in a fourth stage of operation.
Figure 5B:
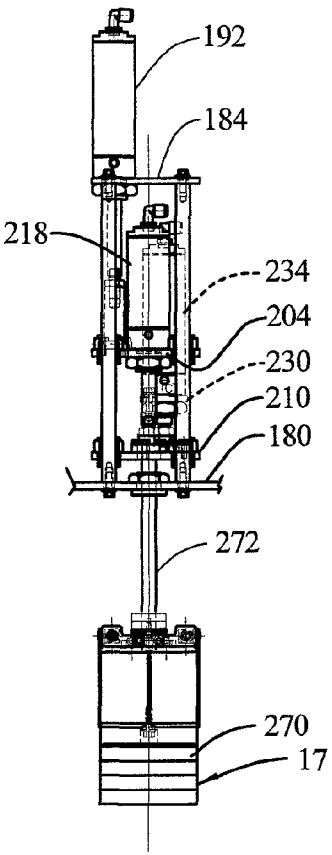
FIG. 5B is a fragmentary sectional view taken generally along line 5B-5B of FIG. 5A with the apparatus shown in a fourth stage of operation.
Figure 5C:
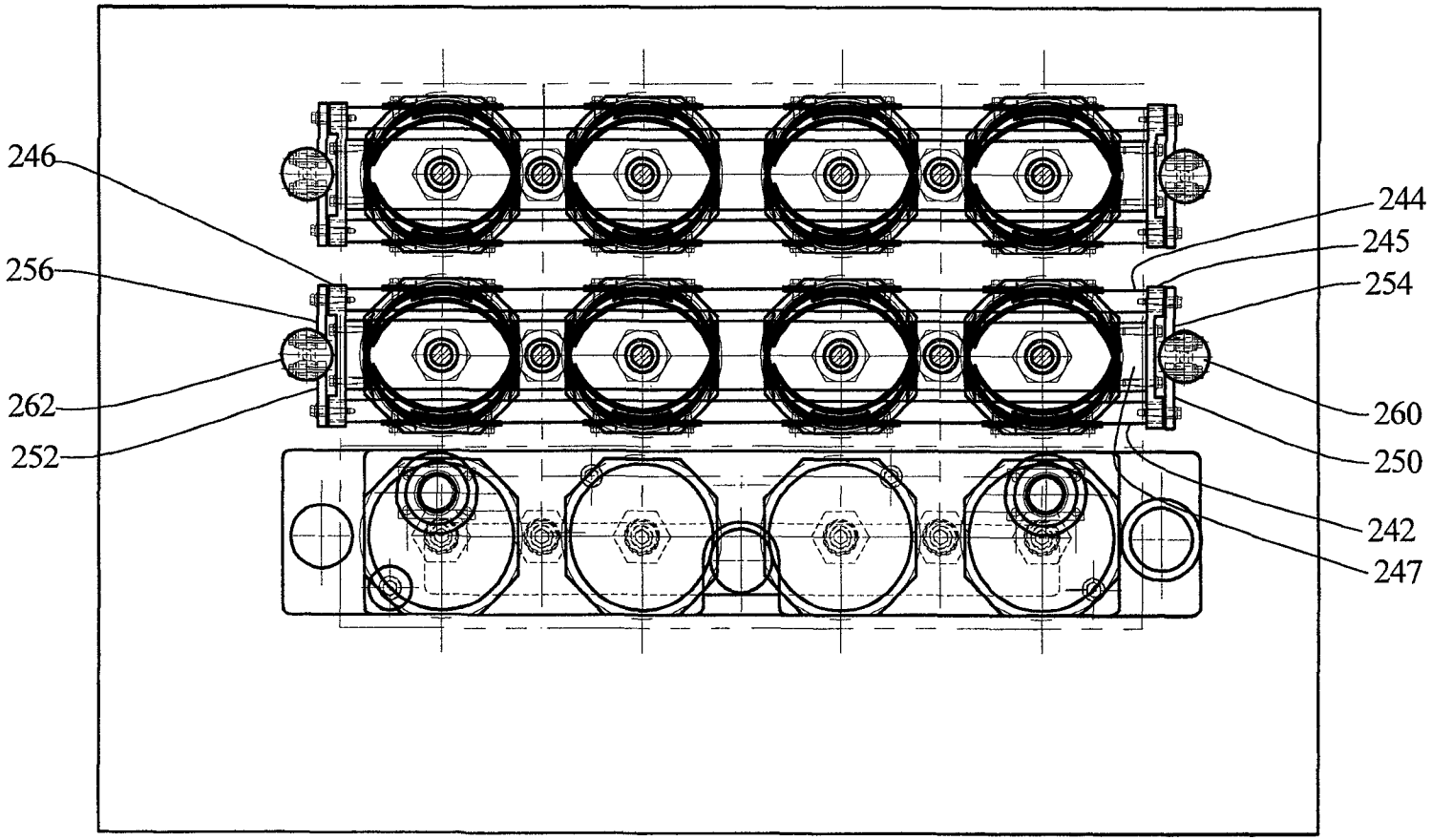
FIG. 5C is a fragmentary sectional view taken generally along bent line 5C-5C of FIG. 1.
Figure 7C:
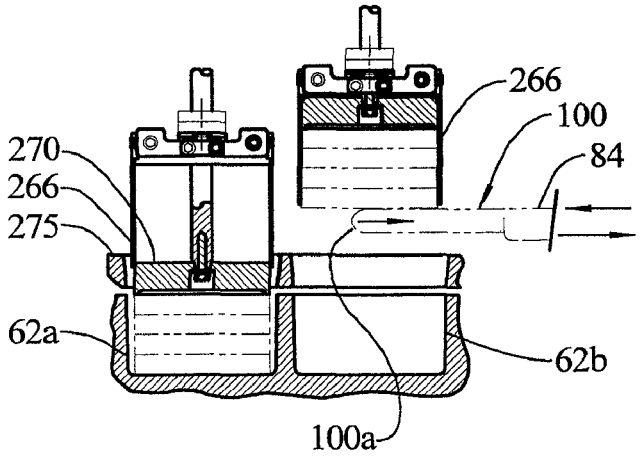

As shown in FIGS. 5A, 5B and 7C, the plungers 270 are then driven further to dispense the stacks 17 out of the guide cylinders 266, and to place or push the stacks 17 into the open top pockets 62 of the row 62*a* or other containers located below the plastic plate 275. The plungers 270 are driven by action of the pneumatic cylinder 234, wherein the rod 234*a* is retracted into the cylinder 234 to drive cylinder 234 and the plate 230 downward with respect to the plate 210.

Figure 8:
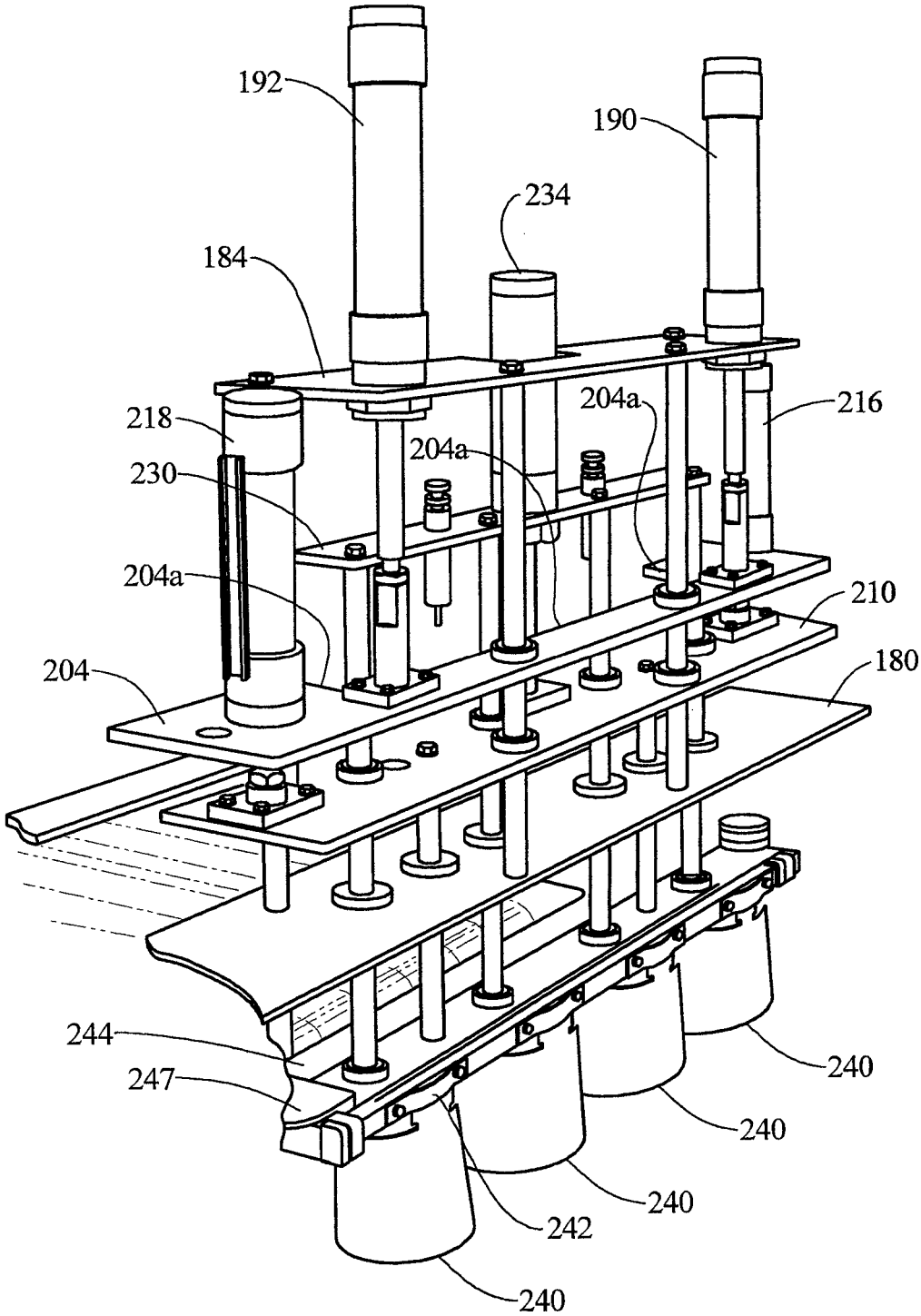
FIG. 8 is a fragmentary, perspective view of the apparatus of FIG. 2A.
Figures 9, 10:
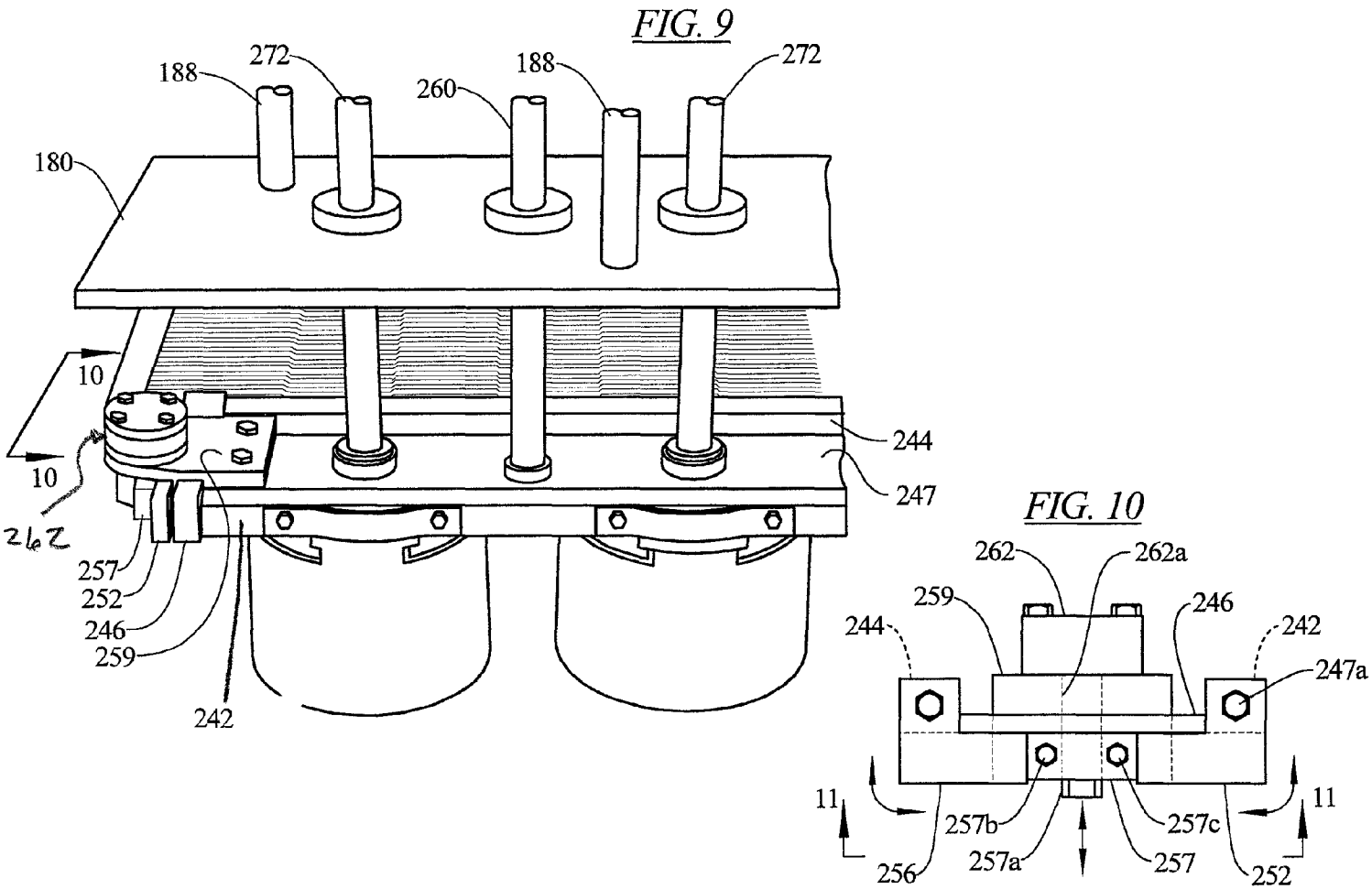
FIG. 9 is an enlarged, fragmentary perspective view of a portion of the apparatus of FIG. 2A.
FIG. 10 is an end view taken generally along line 10-10 of FIG. 9.
Figure 11:
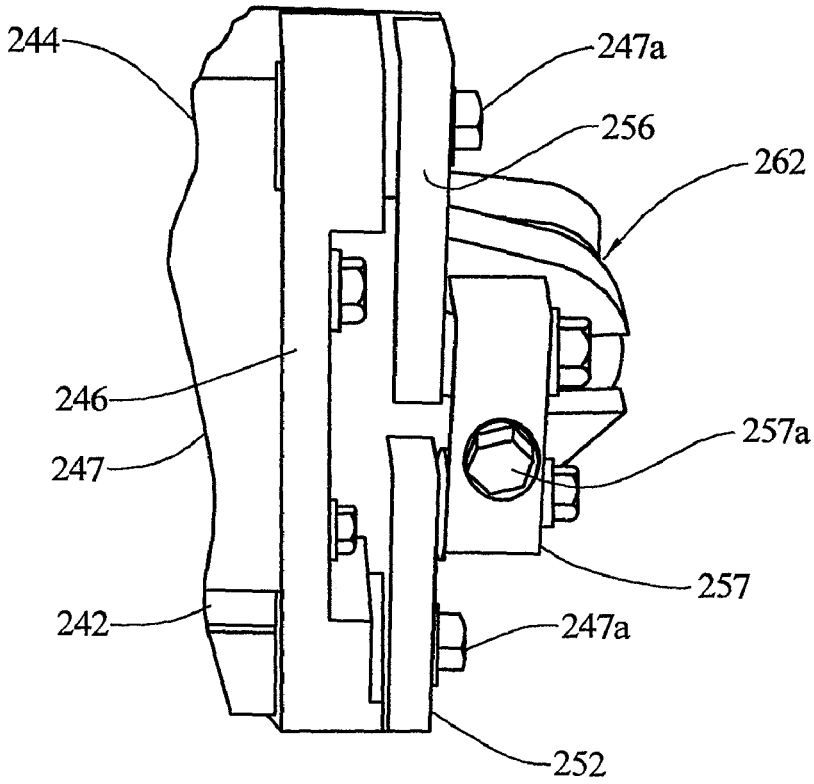
FIG. 11 is a bottom perspective view taken generally along line 11-11 of FIG. 10.

As can be seen by viewing FIG. 4A and FIG. 5A, the plunger drive plate 230 vertically passes the plate 204. This passing is made possible by the plate 204 having a rectangular void 204*a* on a back side thereof which allows the plate 230 to pass vertically behind the plate 204, as seen in FIG. 8.

Hydraulic shock absorber cylinders 230*a*, 230*b* are adjustably fixed to the plunger drive plate 230 and have an impact pin that extends downwardly. These hydraulic shock absorbers are set to strike the guide plate 210 at a bottom of travel of the plunger drive plate 230 to effect a "knock" or rapid deceleration of the plungers 270 at their end of travel to assist in discharging the stacks 17 and separating the stacks 17 from the plungers 270.

The splash plate 275 preferably is composed of plastic, and acts as a debris and spray shield for surrounding areas below the shuttle conveyor.

After the loading apparatus 160*a* has discharged the stacks 17, all the pneumatic cylinders are reversed in operation simultaneously, except the pneumatic cylinders 160, 162, to return to the position and configuration shown in FIG. 2A, ready to load another row of stacks. The pneumatic cylinders 160, 162 are triggered to open the guide cylinders at some time after the guide cylinders are above and clear of the splash plate 275.

As can be understood from FIG. 1 and FIG. 7C, the loading apparatus 160*a*, 160*b*, and 160*c* are triggered sequentially as the leading edge 100*a* of the conveying surface 84 is retracted over the rows of containers 62*a*, 62*b*, 62*c*. FIG. 1 shows the loading apparatus 160*a* in a discharge position corresponding to FIG. 5A, while the loading apparatus 160*b* is in the position corresponding to FIG. 3A, while the loading apparatus 160*c* is in the position corresponding to FIG. 2A. Alternatively, the loading apparatuses 160*a*, 160*b*, 160*c* can simultaneously move the guide cylinders 266 and plungers 270 down to capture three rows of stacks on the conveying surface 84. From that position the guide cylinders and plungers can then be triggered sequentially to perform subsequent movements as the lead end 100*a* is retracted from beneath the rows of stacks.

Figure 6:
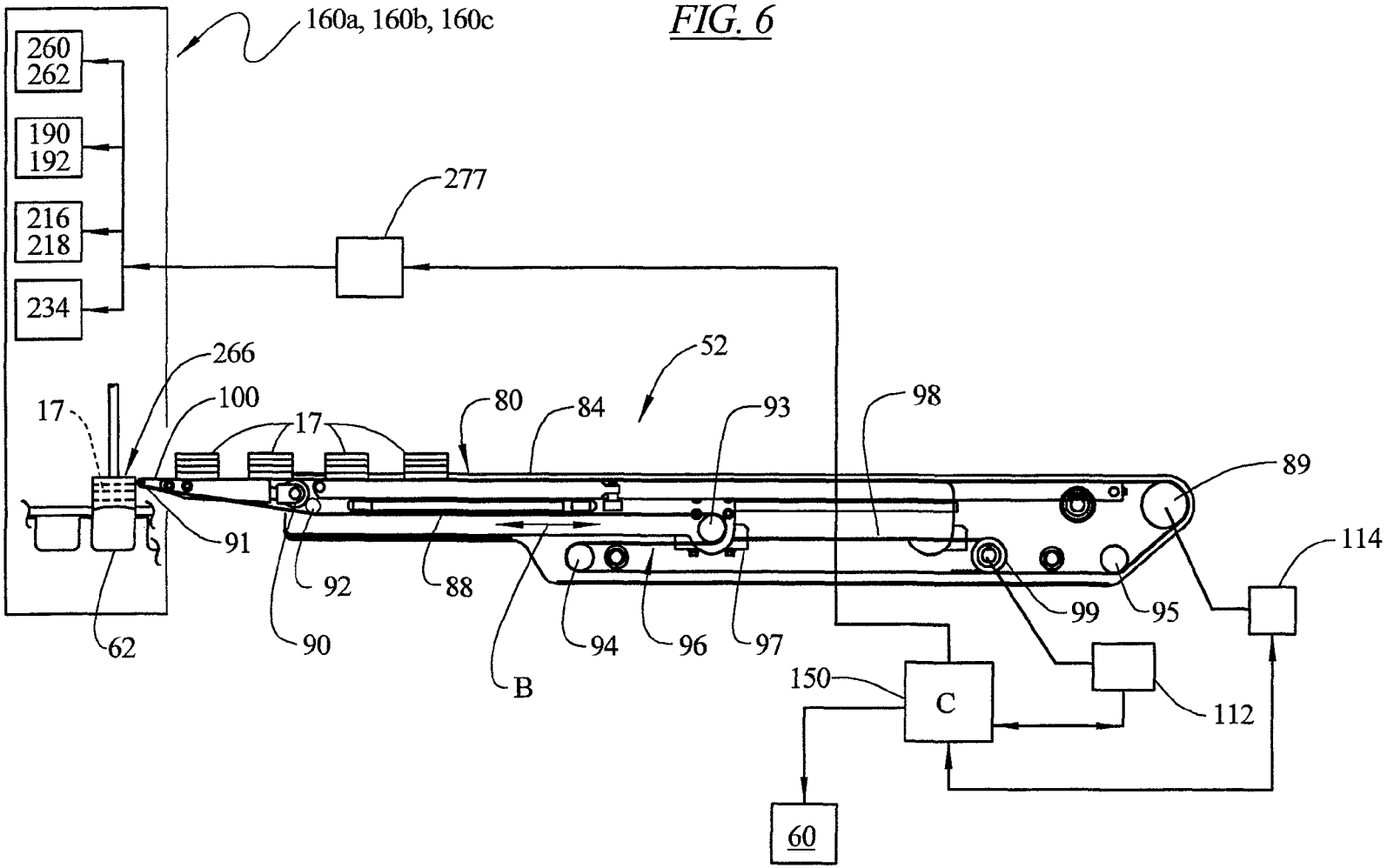
FIG. 6 is a schematic diagram illustrating the control scheme of the invention.

As illustrated in FIG. 6, the central controller 150 can be used to coordinate the loading apparatuses 160*a*, 160*b*, 160*c*, particularly the movements of the guide cylinders 266 and the plungers 270 instigated by the pneumatic cylinders. An electronic-to-pneumatic interface 277 is pneumatically connected to the pneumatic cylinders 260, 262, 190, 192, 216, 218 and 234, and electronically signal-connected to the central controller 150. Based on a precise positioning attributes of the servomotors 112, 114 the pneumatic cylinders can be precisely triggered by the central controller 150 to be in synchronism with the position of the stacks 17 being transported on the shuttle conveyor 80. The central controller 150 also can communicate with the packaging apparatus 60 coordinating movement of the web 63 to deliver new open top containers 62 to the filling station 61.

Figure 12:
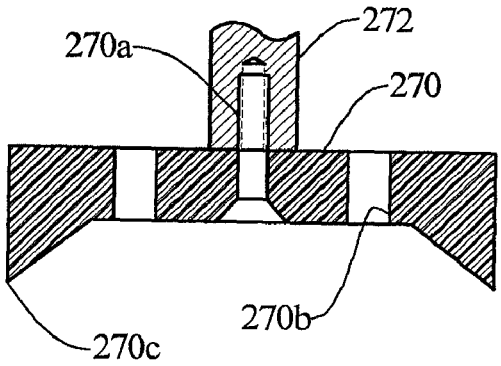
FIG. 12 is a sectional view of a plunger taken generally along line 12-12 of FIG. 5C.

As shown in FIG. 12, each plunger 270 is preferably a plastic, cup shaped element that is fastened by a screw 270*a* to the plunger rod 272. The plunger 270 can have a plurality of holes 270*b* to assist in preventing a vacuum occurring between the plunger 270 and the stacks 17 which would inhibit discharge of the stack 17. Also, the plunger 270 provides a tapered edge 270*c* which causes edge loading of the stack and which also prevent sticking of the stacks 17 to the plungers 270.

Rather than being fed by a patty forming apparatus, the system according to the invention can alternatively be fed by a slicing machine and which cuts slices from a loaf and deposits the slices on an output conveyor assembly, forming stacked drafts. The slicing machine can be of a type as described in U.S. Pat. Nos. 5,649,463; 5,704,265; and 5,974,925; as well as patent publications EP0713753 and WO99/08844, herein incorporated by reference. The slicing machine can also be a commercially available FORMAX FX180 machines, available from Formax, Inc. of Mokena, Ill., U.S.A. The conveyor assembly 16 can be one as described in U.S. Pat. No. 6,763,748, herein incorporated by reference. The conveyor assembly can include a staging conveyor to deliver rows of stacks to the shuttle conveyor 52, such as described in U.S. Pat. No. 5,810,149, herein incorporated by reference.

Figure 13:
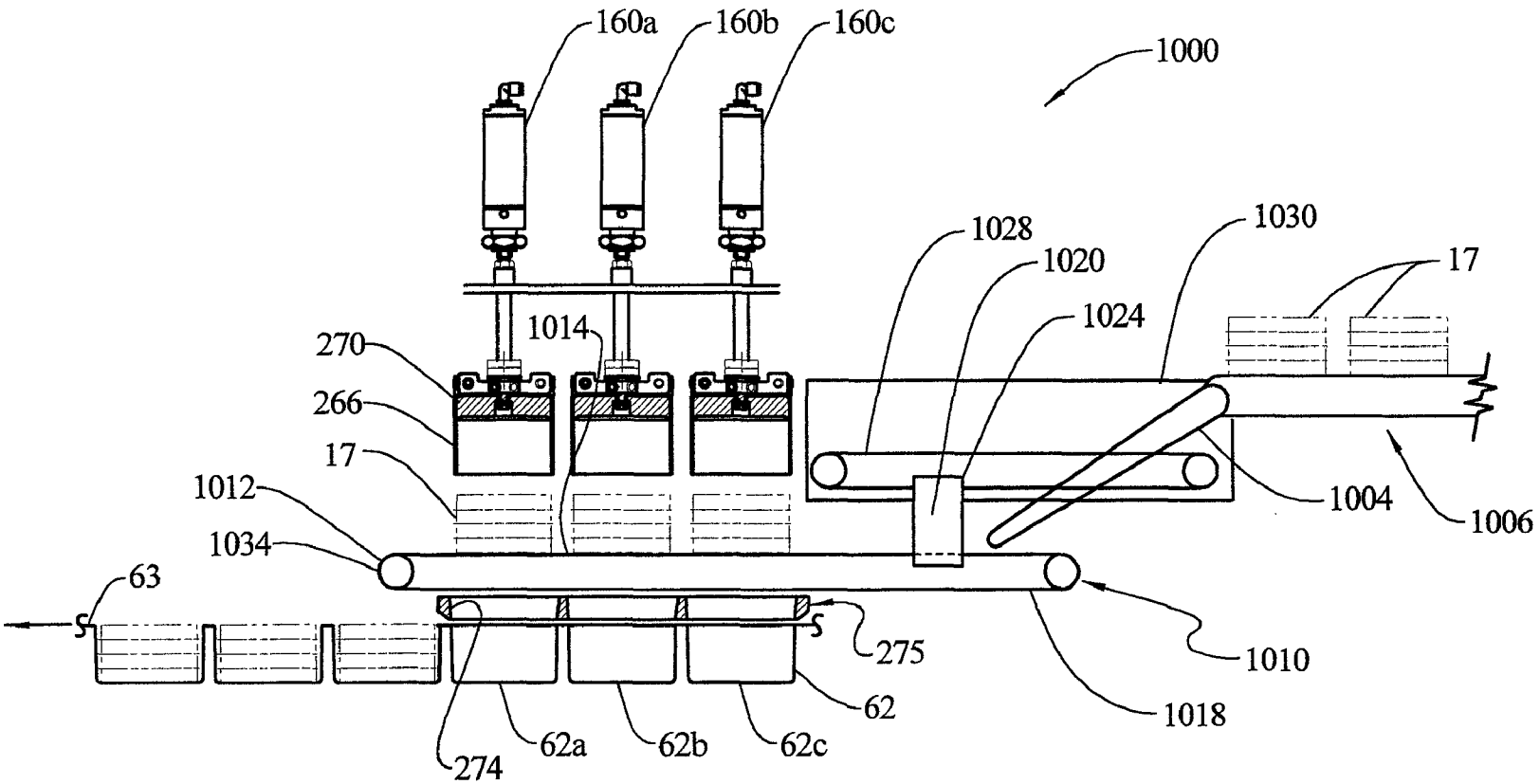
FIG. 13 is a schematic diagram illustrating another embodiment of the invention.

FIG. 13 illustrates an alternate loading system 1000. The system 1000 is similar to the system 10. Like parts are given the same reference number. This system 1000 is particularly advantageous for receiving sliced food product stacks 17 and loading those stacks 17 into containers in the form of pockets 62 arranged in rows 62*a*, 62*b*, 62*c*.

An off loading conveyor 1005 of a staging conveyor 1004 such as described in U.S. Pat. No. 5,810,149 or as commercially available as a FORMAX AUTOLOADER, from Formax, Inc. of Mokena, Ill., U.S.A.

The stacks 17 are deposited onto a movable conveyor 1010 having a driven endless belt 1012 with a top conveying surface 1014 that moves to the left as shown in FIG. 13. The movable conveyor 1010 includes a frame 1018 that is connected by at least one member or bracket 1020 to at least one carriage 1024. The carriage 1024 is connected to an indexing belt 1028 of an indexing conveyor 1030 that is selectively driven to translate the carriage 1024 along a length of the conveyor 1030 in either direction.

The loading apparatuses 160*a*, 160*b*, 160*c* are arranged above the conveying surface 1014 above the splash shield 275 and the rows of pockets 62*a*, 62*b*, 62*c* as per the first described embodiment.

In operation, rows of stacks 17 are loaded onto the conveying surface 1014 from the off loading conveyor 1004. The surface 1014 delivers the stacks to their positions as shown in FIG. 13. At these positions, the loading apparatuses 160*a*, 160*b*, 160*c* can cause the guide cylinders 266 to sequentially descend to capture the stacks as per the first described embodiment, or the guide cylinders 266 of the apparatuses 160*a*, 160*b*, 160*c* can descend at the same time to capture the three rows of stacks on the conveying surface.

The off loading conveyor 1004 is stopped and the indexing conveyor is controlled to drive the conveyor 1010 to the right at the same speed as the conveying surface 1014 is driven to the left. The stacks are thus effectively stationary with respect to the apparatuses 160*a*, 160*b*, 160*c*. When the leading edge 1034 of the conveying surface is removed from beneath the first captured row of stacks 17, the loading apparatus 160*a* drives the guide cylinders 266 downward to the holes 274 in the splash plate 275, past the conveyor 1010. The loading apparatuses 160*b* and 160*c* are similarly operated once the leading edge 1034 passes from beneath the respective captured rows of stacks 17. Once each row of containers 62*a*, 62*b*, 62*c* is filled, the loading apparatuses 160*a*, 160*b*, 160*c* respectively retract the guide cylinders 266 and plungers 270 upwardly as previously described. Alternately, once all three rows of containers 62*a*, 62*b*, 62*c* are filled the apparatuses 160*a*, 160*b*, 160*c* can all retract their perspective rows of guide cylinders 266 and plungers 270. The conveyor 1010 can be shifted to the left by operation of the indexing conveyor 1030 and the off load conveyor 1014 can begin again to load rows of stacks onto the conveying surface 1014. A new set of empty containers 62 corresponding to the rows 62*a*, 62*b*, 62*c* are indexed to positions beneath the apparatuses 160*a*, 160*b*, 160*c*.

Figure 14:
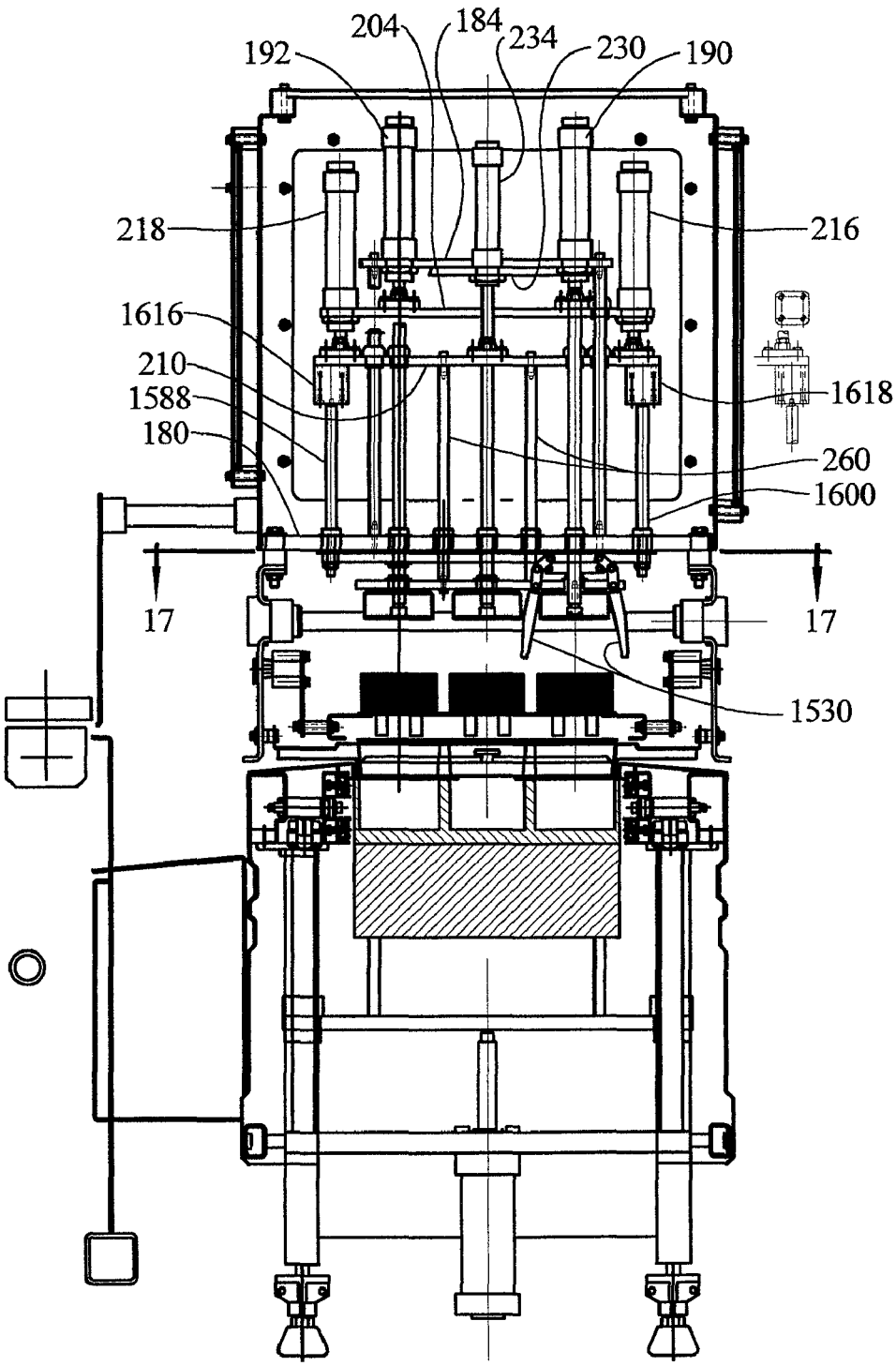
FIG. 14 is a fragmentary sectional view as taken generally along line 2A-2A of FIG. 1 of an alternate embodiment of the invention.

FIG. 14 illustrates an alternate embodiment of the invention. According to this embodiment, the guide cylinders are replaced with guide arms. Particularly, each guide cylinder is replaced by four guide arms arranged spaced apart around a perimeter of the stack to be guided. For simplicity, only two guide arms of one set of guide arms are shown in FIG. 14. The preferred function of the guide arms is the same as the preferred function of the guide cylinder, that is, to spread apart before being lowered to capture a stack on the conveyor belt, and thereafter to be closed around the stack and lowered further to guide the stack into an open container, assisted by the plunger arranged within and between the guide arms.

Figure 15:
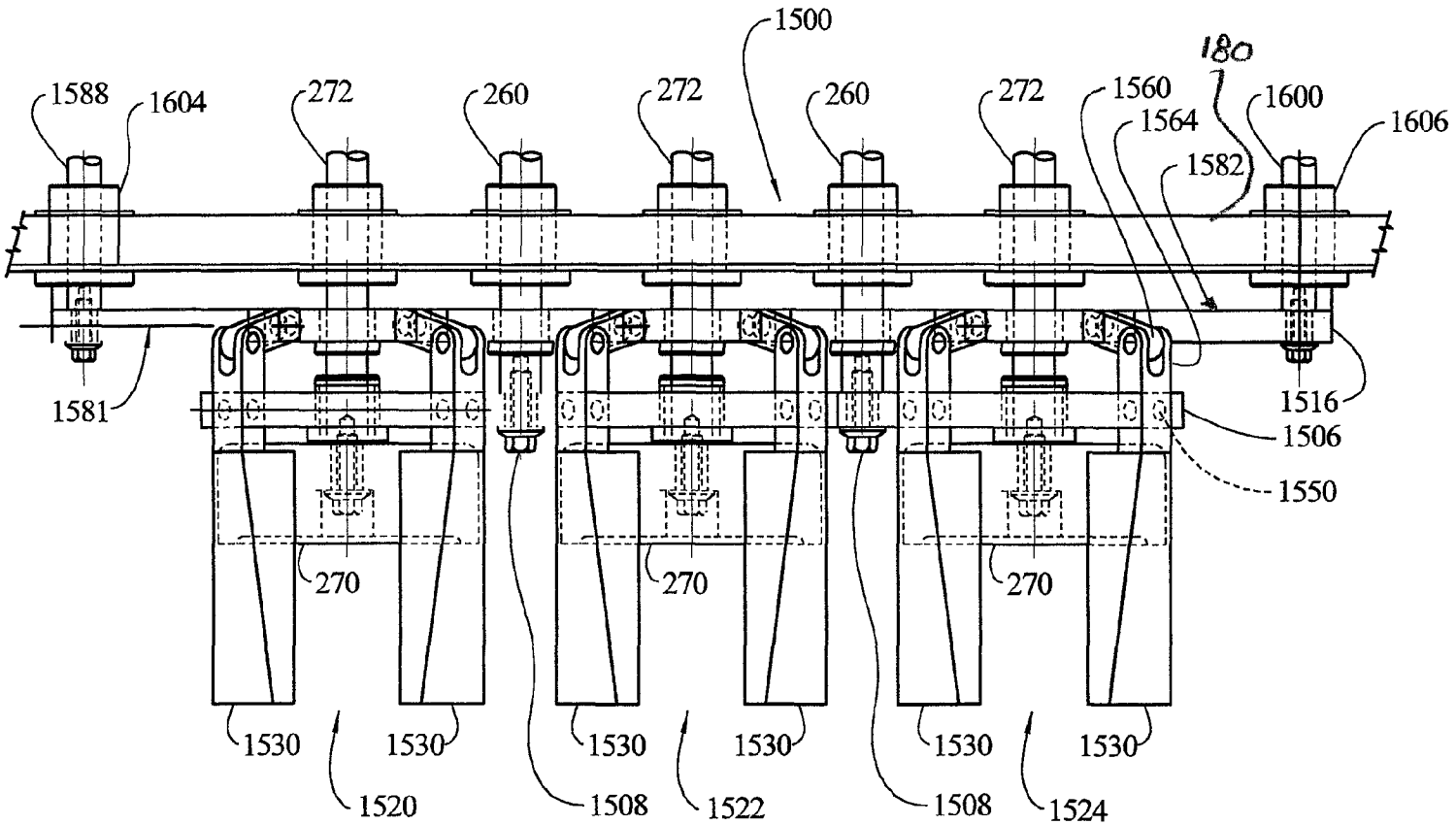
FIG. 15 is an enlarged detail view taken from FIG. 14.

FIG. 15 illustrates in more detail the construction of the alternate guiding assembly 1500. A support plate 1506 replaces the above-described center plate 247. The support plate 1506 is fixed to the rods 260 by fasteners 1508. A lift plate 1516 is arranged above the support plate 1506. Three guiding devices 1520, 1522, 1524, are illustrated that are arranged in a lateral row and supported by the support plate 1506. Each guiding device includes four guide arms 1530. The guide arms are arranged spaced apart in a horizontal plane at 90 degree spacing, offset in the horizontal plane by 45° from a lateral line that is aligned across the row of guiding devices 1520, 1522, 1524. The arms include a guide surface 1530*a* that faces in a radial direction toward a vertical centerline of the respective plunger rod 272. The surface 1530*a* (FIG. 18) can be curved or shaped to match the outside surface of the stack to be guided.

Each guide arm 1530 is pivotally connected to the support plate 1506 by a faster pin 1536 (FIGS. 18 and 19) that spans a slot 1542 in the support plate. The faster pin 1536 includes a head 1536*a*, a smooth shaft 1536*b* that passes through a plain bore 1543 through the plate, and a threaded end 1536*c* that engages a threaded bore 1544 in the support plate, opposite the plain bore 1543. The smooth shaft 1536 penetrates a hole 1550 in the guide arm 1530 (FIG. 15) to pivotally connect the guide arm to the support plate 1506.

The guide arm 1530 is pinned for pivoting to a link 1560 using a pin 1564 (FIGS. 15 and 18) that spans a yoke 1568 formed in a top end of the guide arm. One side of the yoke has a first plain hole and the opposite side of the yoke has a corresponding second plain hole wherein the pin 1564 can be inserted through the first plain hole, penetrate a hole or channel in the link 1560 and be inserted into the corresponding second plain hole on the other side of the yoke. End portions of the pin 1564 protrude outside the yoke on opposite sides of the yoke and the protruding end portions each include a circumferential groove which is exposed outside the yoke and which receives a C-clip retainer or spring clip partly therein to retain the pin onto the yoke.

Figure 18:
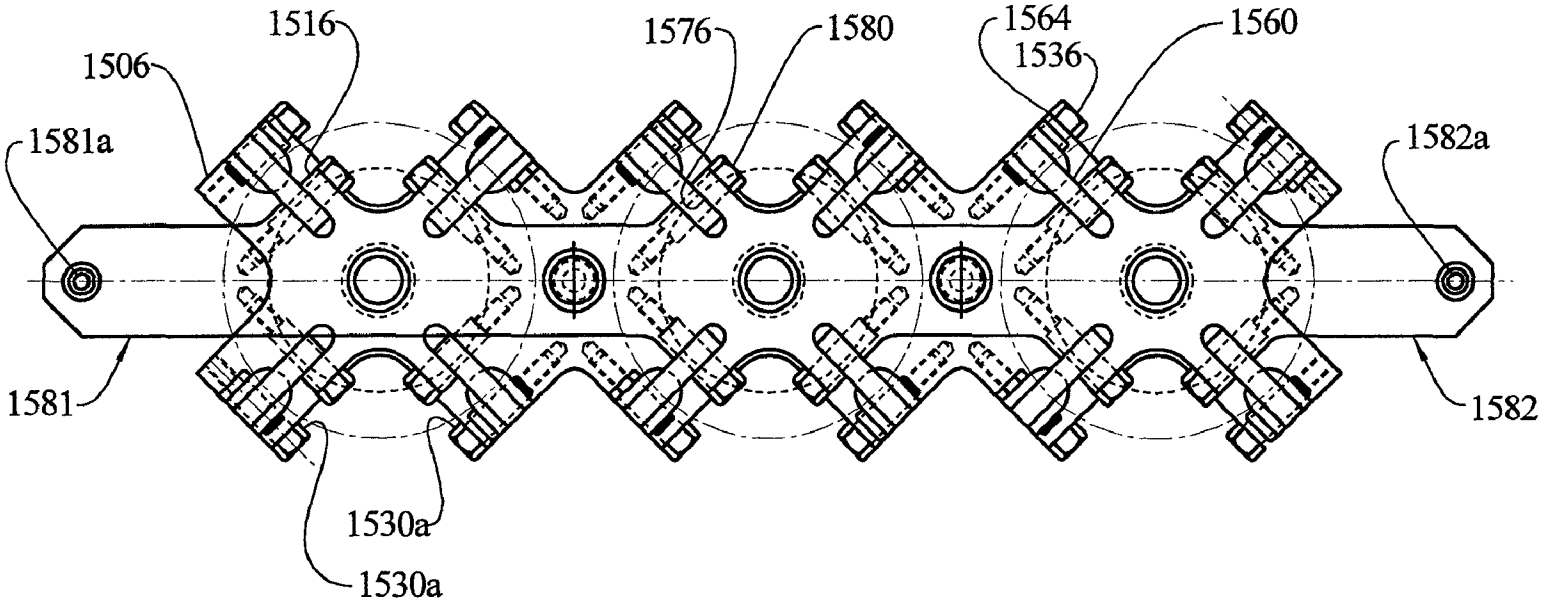
FIG. 18 is an enlarged detail view taken from FIG. 17.
Figure 19:
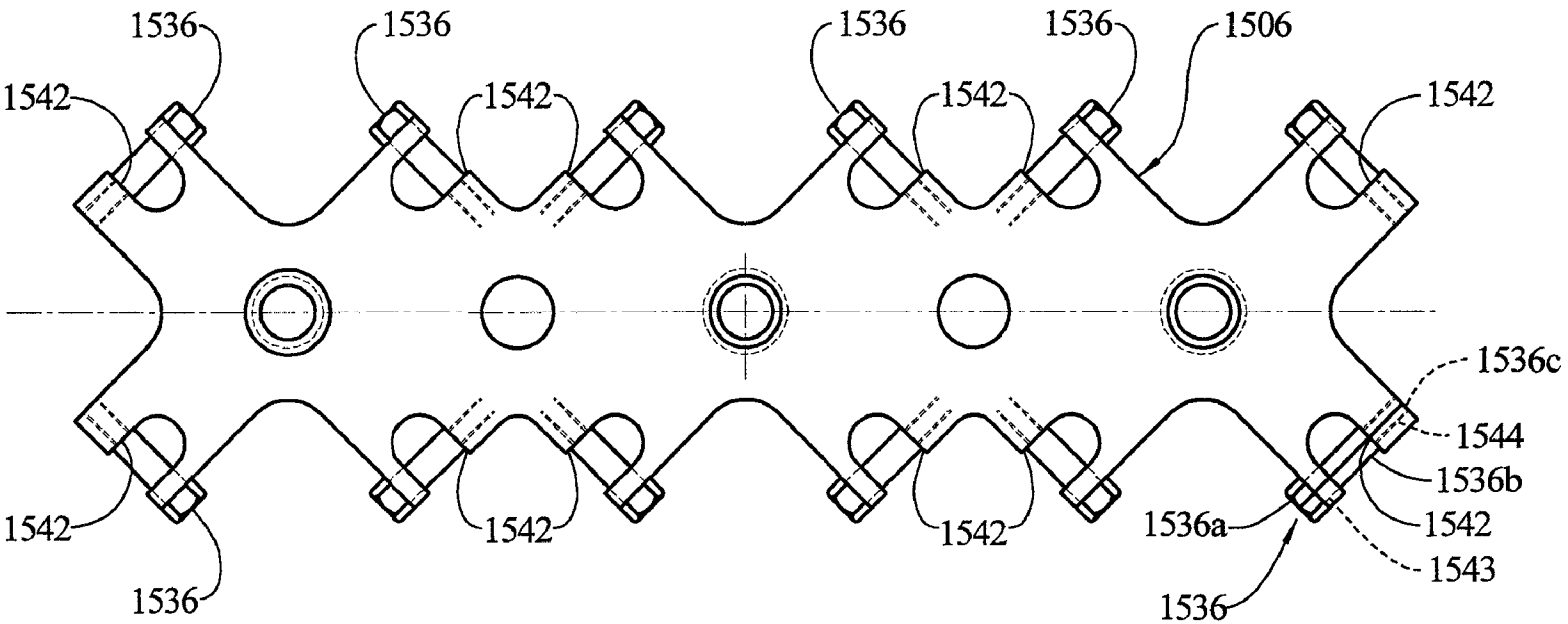
FIG. 19 is a plan view of a support plate taken from FIG. 18.
Figure 20:
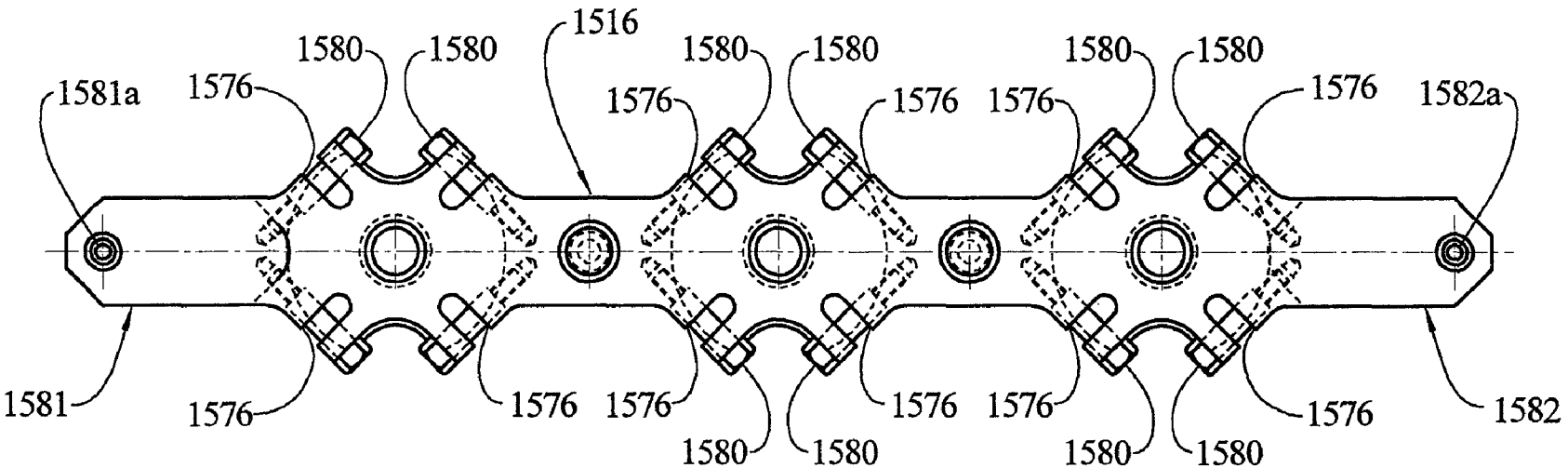
FIG. 20 is a plan view of a lift bar taken from FIG. 18.

An opposite end of the link 1560 is fit into a slot 1576 provided in the lift bar 1516 (FIGS. 18 and 20). A threaded end pin 1580 is inserted through a plain hole and is threadingly engaged by a tapped hole, the holes on opposite sides of each slot. The pin 1580 captures a hole provided through the link 1560. Thus, the link is pivotally connected at one and to the guide arm and at an opposite end to the lift plate.

FIG. 18 shows the lift plate includes opposite and regions 1581, 1582 having mounting holes 1581*a*, 1582*a*. FIG. 15 shows vertical rods 1588, 1600 fastened to the lift plate 1506 at the mounting holes 1581*a*, 1582*a*. The rods 1588, 1600 are arranged to slide vertically through bearings 1604, 1606 fit into the base plate 180.

Returning to FIG. 14, the rods 1588, 1600 extend up and are connected to pneumatic cylinders 1616, 1618 which act on the rods to selectively lift or lower the rods. Pneumatic cylinders 1616, 1618 are fastened to the guide plate 210 to move therewith.

Figure 16:
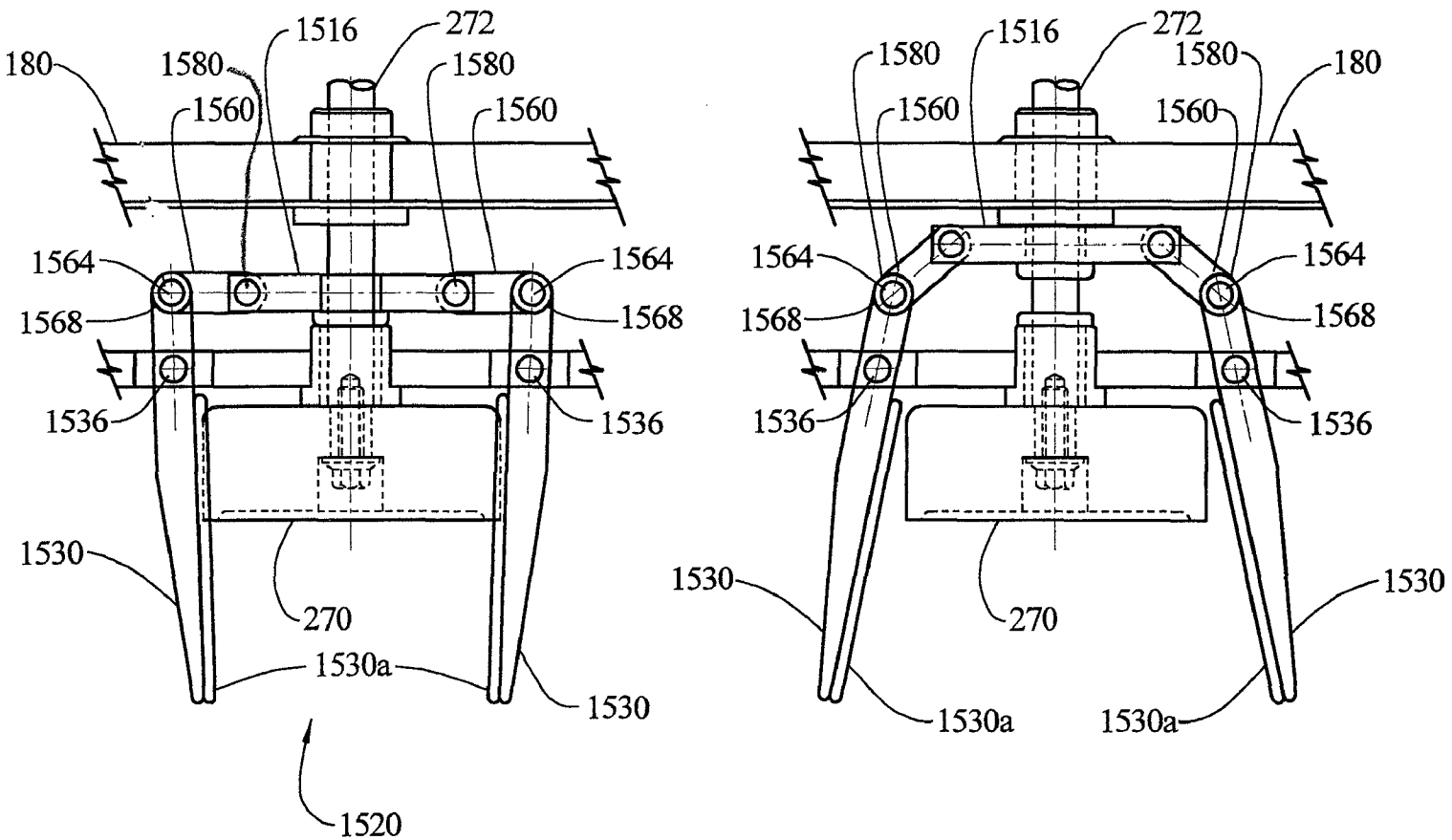
FIG. 16 is a schematical view illustrating the guide arms of FIG. 14 in both opened and closed orientation.

FIG. 16 illustrates the operation of the guide device 1520, which is typical of all the guide devices of the guiding assembly 1500. On the left side of FIG. 16 the guide device is shown with the arms 1530 in a closed orientation such as when a stack has been captured on the conveyor belt. In this orientation, the pneumatic cylinders 1616, 1618 have been lowered and the lift bar 1516 is at a lowered position, shown substantially horizontal in FIG. 16. To open up the arms 1530, and viewing the right side of FIG. 16, the pneumatic cylinders 1616, 1618 raise the rods 1588, 1600 (FIG. 14) which raises the lift bar 1516 as shown. Once the lift bar 1516 is raised, the links 1560 are pulled upwardly and angled to the orientation shown. The links 1560 pivot about the pins 1580, 1564. The links 1560 draw the yokes 1568 of the guide arms 1530 inwardly and the guide arms 1530 pivot about the pins 1536 to be spread apart at bottoms thereof. Although only two guide arms 1530 are shown being operated, it should be understood that when the lift bar 1516 is raised, all guide arms 1530 of the assembly 1500 that are connected to the lift bar 1516 will be pivoted.

Thus, it can be recognized that the pneumatic cylinders 1616, 1618 replace the pivot cylinders 260, 262 of the previously described embodiment, but the timing and operation of these cylinder 1616, 1618 is substantially the same.

Figure 17:
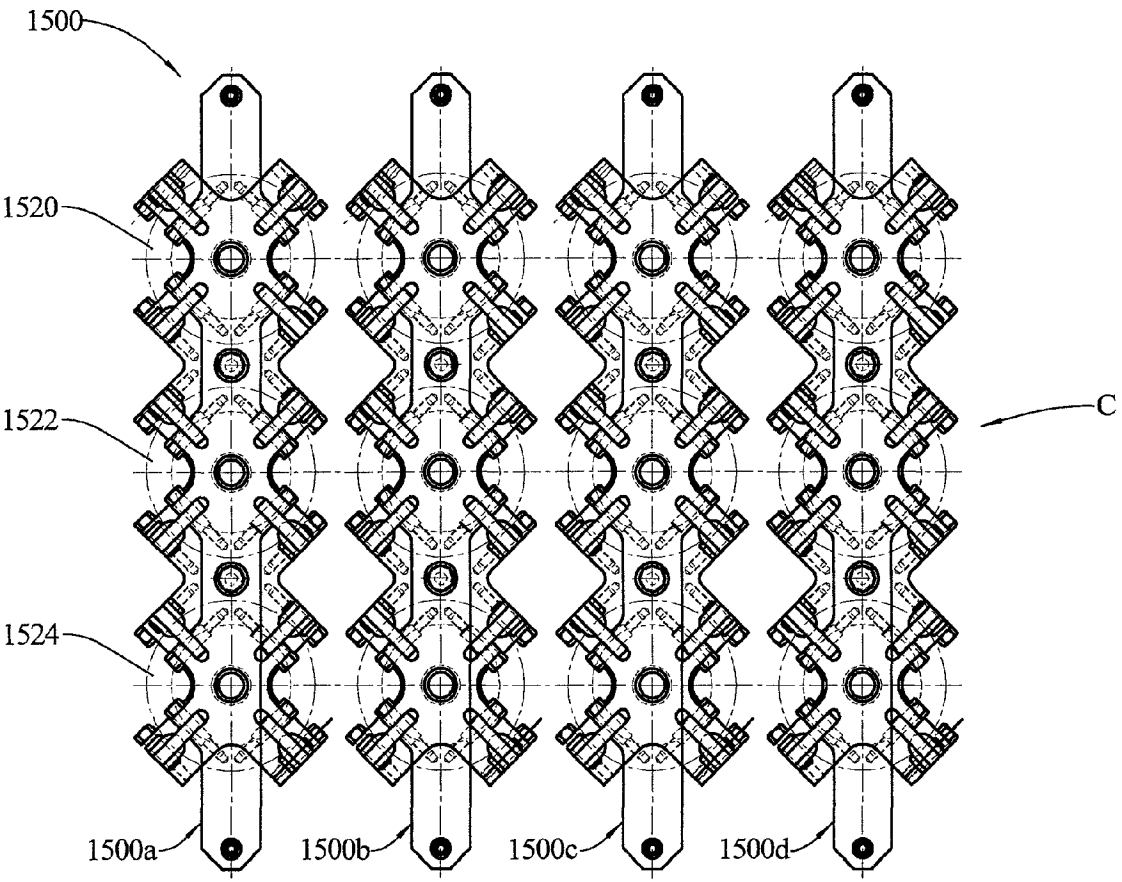
FIG. 17 a fragmentary sectional view as taken generally along line 17-17 of FIG. 14.

FIG. 17 illustrates that a plurality of rows of guiding assemblies 1500 can be used on the machine, such as the rows 1500*a*, 1500*b*, 1500*c*, 1500*d* arranged spanning laterally to the longitudinal conveyor direction C. Each row includes a plurality of guide devices, such as three, 1520, 1522, and 1524.

As can be seen in the figures, wherever rods penetrate plates and are movable with respect thereto, a plastic bushing, sleeve, bearing or guide is provided to reduce friction and noise, and to ensure smooth operation of the apparatus.

Although pneumatic cylinders are used in the exemplary embodiments to cause movement of the guide cylinders and plungers, such pneumatic cylinders could be replaced with a variety of types of drives all within the scope of the invention. Servo motor drives, hydraulic drives, linear actuators, and other drives are all encompassed by the invention.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A method of loading food products into packaging, comprising the steps of:

providing a food product on a support surface;

engaging said food product with a guiding device that does not come in contact with the bottom surface of the food product;

removing said support surface from beneath said food product;

lowering said food product with said guiding device to a position above said packaging without any intervening vertical support;

releasing said food product from said guiding device into said packaging.

2. The method of loading food products into packaging according to claim 1, wherein the step of lowering is further synchronized to lower food product from said support surface into the packaging.

3. The method of loading food products into packaging according to claim 1, wherein the providing step comprises: moving the food product along said support surface to a lead position on said surface, wherein said support surface is a conveyor.

4. The method of loading food products into packaging according to claim 1, wherein the engaging step comprises gripping the sides of said food product at said lead position with said guiding device; and wherein the removing step comprises horizontally retracting said support surface.

5. The method of loading food products into packaging according to claim 1, wherein the engaging step comprises gripping the sides of said food product with said guiding device.

6. The method of loading food products into packaging according to claim 5, wherein the engaging step comprises gripping the entire surface of the sides of said food product with said guiding device.

7. The method of loading food products into packaging according to claim 1, wherein the removing step comprises horizontally retracting said support surface.

8. The method of loading food products into packaging according to claim 1, wherein the releasing step comprises: pushing the food products downwardly with a plunger to expel the food products from the guiding device into the packaging.

9. The method according to claim 8, wherein the steps of lowering, releasing and pushing are synchronized to push food product from said conveying surface end region into the packaging directly without any intervening vertical support of the food product.

10. The method of loading food products into packaging according to claim 8, wherein the releasing step comprises: separating said food products from said plunger at an end of plunger travel by striking a guide plate with a shock absorber operatively connected to said plunger.

11. The method of loading food products into packaging according to claim 1, wherein the lowering step comprises: providing said packaging removably within a frame below said guiding device and lowering the food product and guiding device into a receiving area of said frame.

12. A method of loading food products into packaging, comprising the steps of:

moving the food product along a conveying support surface to a lead position on said surface;

providing said packaging below said lead position of said support surface;

gripping the food product at said lead position with a guiding device that does not come in contact with the bottom surface of the food product;

horizontally retracting said support surface from beneath said food product;

lowering said food product with said guiding device to a position above said packaging;

releasing said food product from said guiding device; and pushing the food product downwardly with a plunger to expel the food product from said guiding device into the packaging.

13. The method of loading food products into packaging according to claim 12, wherein the releasing step comprises: separating said food products from said plunger at an end of plunger travel by striking a guide plate with a shock absorber operatively connected to said plunger.

14. The method according to claim 12, wherein the steps of lowering, releasing, and pushing are synchronized to push the food product from said conveying surface end region into the packaging directly without any intervening vertical support of the food product.

15. The method of loading food products into packaging according to claim 12, which further comprises the steps of:

retracting said plunger within said guiding device;

raising said guiding device;

returning said support surface to a position above the packaging immediately after said raising of said guiding device; and repeating the steps of moving, providing, gripping, horizontally retracting, lowering, pushing, retracting said plunger, raising, and returning, while said food products are provided onto said conveying support surface for packaging.

16. A method of loading food products into packaging, comprising the steps of:

moving an end portion of a conveying support surface to a home position above said packaging in a loading station;

moving the food product along said conveying support surface to a lead position on said end portion;

gripping the food product at said lead position with a guiding device that does not come in contact with the bottom surface of the food product;

horizontally retracting said support surface from beneath said food product to a retracted position;

lowering said food product with said guiding device to a position above said packaging without any intervening vertical support;

releasing said food product from said guiding device;

pushing the food products downwardly with a plunger to expel the food products from said guiding device into said packaging.

17. The method of loading food products into packaging according to claim 16, which further comprises the steps of:

retracting said plunger within said guiding device;

raising said guiding device;

returning said support surface to said home position immediately after said raising of said guiding device; and repeating the steps of moving, providing, gripping, horizontally retracting, lowering, releasing, pushing, retracting said plunger, raising, and returning, while said food products are provided onto said conveying support surface for packaging.

* * * * *